US009624922B2

(12) United States Patent
Holzel et al.

(10) Patent No.: US 9,624,922 B2
(45) Date of Patent: Apr. 18, 2017

(54) PRESSURE MONITORING DEVICE FOR CONTROLLING A COMPRESSOR

(71) Applicants: WABCO Europe BVBA, Brussels (BE); WABCO Compressor Manufacturing Co., Charleston, SC (US)

(72) Inventors: Folkhard Holzel, Banteln (DE); Michael Klatt, Wadmalaw Island, SC (US); Ramesh Pai, Charleston, SC (US)

(73) Assignees: WABCO EUROPE BVBA, Brussels (BE); WABCO COMPRESSOR MANUFACTURING CO., Charleston, SC (US)

( * ) Notice: Subject to any disclaimer, the term of this patent is extended or adjusted under 35 U.S.C. 154(b) by 927 days.

(21) Appl. No.: 13/770,519

(22) Filed: Feb. 19, 2013

(65) Prior Publication Data

US 2014/0234131 A1 Aug. 21, 2014

(51) Int. Cl.

| | |
|---|---|
| ***F04B 49/03*** | (2006.01) |
| ***F04B 49/035*** | (2006.01) |
| ***F04B 49/22*** | (2006.01) |
| ***F04B 39/12*** | (2006.01) |

(52) U.S. Cl.

CPC ..... *F04B 49/22* (2013.01); *F04B 39/125* (2013.01); *F04B 49/03* (2013.01); *F04B 49/035* (2013.01); *Y10T 137/2544* (2015.04); *Y10T 137/85986* (2015.04)

(58) Field of Classification Search

CPC .... Y10T 137/2544; F04B 49/02; F04B 49/03; F04B 49/035

USPC ..... 137/102

See application file for complete search history.

(56) References Cited

U.S. PATENT DOCUMENTS

| | | | | |
|---|---|---|---|---|
| 3,545,887 | A | 12/1970 | Kobnick | |
| 3,670,756 | A * | 6/1972 | Schultz | B60T 15/50 137/102 |
| 3,834,837 | A * | 9/1974 | Nickell | F04B 39/125 137/102 |
| 3,888,603 | A * | 6/1975 | Nagase | G05D 16/0602 417/25 |
| 5,694,965 | A * | 12/1997 | Roulet | G05D 16/10 137/102 |
| 8,408,232 | B2 * | 4/2013 | Schisler | F15B 1/027 137/102 |
| 8,960,073 | B2 * | 2/2015 | Pai | F04B 39/123 29/888.02 |

FOREIGN PATENT DOCUMENTS

| | | |
|---|---|---|
| GB | 1006806 | 10/1963 |

* cited by examiner

*Primary Examiner* — Peter J Bertheaud

(74) *Attorney, Agent, or Firm* — Warner Norcross & Judd LLP

(57) ABSTRACT

A pressure monitoring device for use in an air system of a vehicle and for controlling a compressor comprises an input air connector for connection to an air tank and for receiving an input pressure from the air tank. A first signal air connector can output a pneumatic ON-load signal for adjusting the compressor to an operation mode. A second signal air connector can output a pneumatic OFF-load signal for adjusting the compressor to a non-operation mode.

10 Claims, 2 Drawing Sheets

PRESSURE MONITORING DEVICE FOR CONTROLLING A COMPRESSOR

FIELD OF THE INVENTION

The present invention generally relates to a pressure monitoring device for use in controlling a compressor, in particular in an air system of a vehicle.

BACKGROUND OF THE INVENTION

A pressure monitoring device of the general type under consideration is known as a "governor". It is used as a device that monitors the air pressure in a tank connected to an input air connector of the governor and outputs pressure signals as pneumatic signals to an air compressor. The compressor is provided for pumping air in an operation mode, which may be called the "on-load-state", and for not pumping air in a non-operation mode, which may be called the "off-load-state". This non-operation mode can be an idle state, in which the compressor is not switched off, or it can be a switched-off state.

GB 1,006,806 A, U.S. Pat. No. 3,834,837, U.S. Pat. No. 3,545,887 describe governors of the general type under consideration, which are mechanical devices comprising mechanical parts. In general, a governor is used to limit the pressure in the tank; if a pressure limit is reached or exceeded, the governor connected to the pressurized air tank detects this state and outputs an OFF-load signal to the compressor in order to switch it into its off-load-state.

A governor comprises a spring mechanism to compare the pressure received in the input air connector with a spring force of the spring mechanism. However, debris in the air compressor or inconsistent venting of the governor signal, weak springs or stuck unloader mechanisms may lead to failures in outputting the OFF-load signal.

Further problems may arise when a leak is present in the signal line from the governor to the compressor. This may cause the governor to become slow or sluggish during the vent cycle and may lead to failure in the air compressor unloader mechanism.

SUMMARY OF THE INVENTION

Generally speaking, it is an object of the present invention to provide a pressure monitoring device suitable for controlling a compressor that prevents uncertain or undefined states of the compressor. Further objects of the invention are to provide a head unloader of a compressor and a compressor that can be controlled by such a pressure monitoring device.

According to one embodiment of the present invention, a pressure monitoring device for use in an air system of a vehicle and for controlling a compressor includes an input air connector for connection to an air tank and for receiving an input pressure from the air tank. It also includes a first signal air connector for outputting a pneumatic ON-load signal for adjusting the compressor to an operation mode, and a second signal air connector for outputting a pneumatic OFF-load signal for adjusting the compressor to a non-operation mode.

According to a further embodiment of the invention, the compressor for compressing air and outputting pressurized air includes a head unloader that has a first signal port and a second signal port. The first signal port can receive the pneumatic ON-load signal for adjusting the compressor to an operation mode, and the second signal port can receive the pneumatic OFF-load signal for adjusting the compressor to a non-operation mode.

Thus, the pressure monitoring device according to the inventive embodiments can output two pressure signals (pneumatic signals): the OFF-load signal for switching the compressor into its off-load state (or adjusting the off-load state) and the ON-load signal to be delivered to the compressor in order to adjust its on-load state or operation load. The ON-load signal is helpful in securing the on-load state of the compressor. The changes between the on-load state and the off-load state are therefore indicated not only by one signal, but by changing from one signal to the other signal.

It should be appreciated that the disadvantages of conventional constructions in the event of a leak can be avoided; in case of an on-load state, the ON-load signal is output from the pressure monitoring device to the compressor.

Another advantage of the inventive pressure monitoring device is that it can be constructed and mounted with only a few parts.

According to a further embodiment of the present invention, only one additional movable part is provided—namely, a pressure plunger.

According to a still further embodiment, the pressure monitoring device can be constructed with a governor body as a housing, a movable piston and two plungers, which comprise a vent hole, respectively, as well as springs, O-rings and valves.

According to yet a further embodiment, the head unloader comprises a piston to be charged with the pneumatic ON-load signal from one end to be pushed into a first direction to adjust its on-load state and by the pneumatic OFF-load signal from its other end to be pushed into a second direction opposite to the first direction to adjust its off-load state. Thus, the piston can be pushed by air pressure in both directions—the first direction for adjusting the off-load state, and the reverse direction for switching into the on-load state. It should be appreciated that issues that can be presented by a weakened spring mechanism, which may be aged or fatigued or may be affected by a stuck unloader or by debris and therefore possibly unable to push the piston back into a basic position if the supplied pressure signal is switched off; can be avoided by the piston being able to be moved in both directions by input pressure signals.

Still other objects and advantages of the present invention will in part be obvious and will in part be apparent from the specification.

The present invention accordingly embodies features of construction, combinations of elements, and arrangement of parts, all as exemplified in the following detailed disclosure, and the scope of the invention will be indicated in the claims.

BRIEF DESCRIPTION OF THE DRAWINGS

For a fuller understanding of the inventive embodiments, reference is had to the following description taken in connection with the accompanying drawings in which.

DETAILED DESCRIPTION OF THE PREFERRED EMBODIMENTS

Figures 1A, 1B:
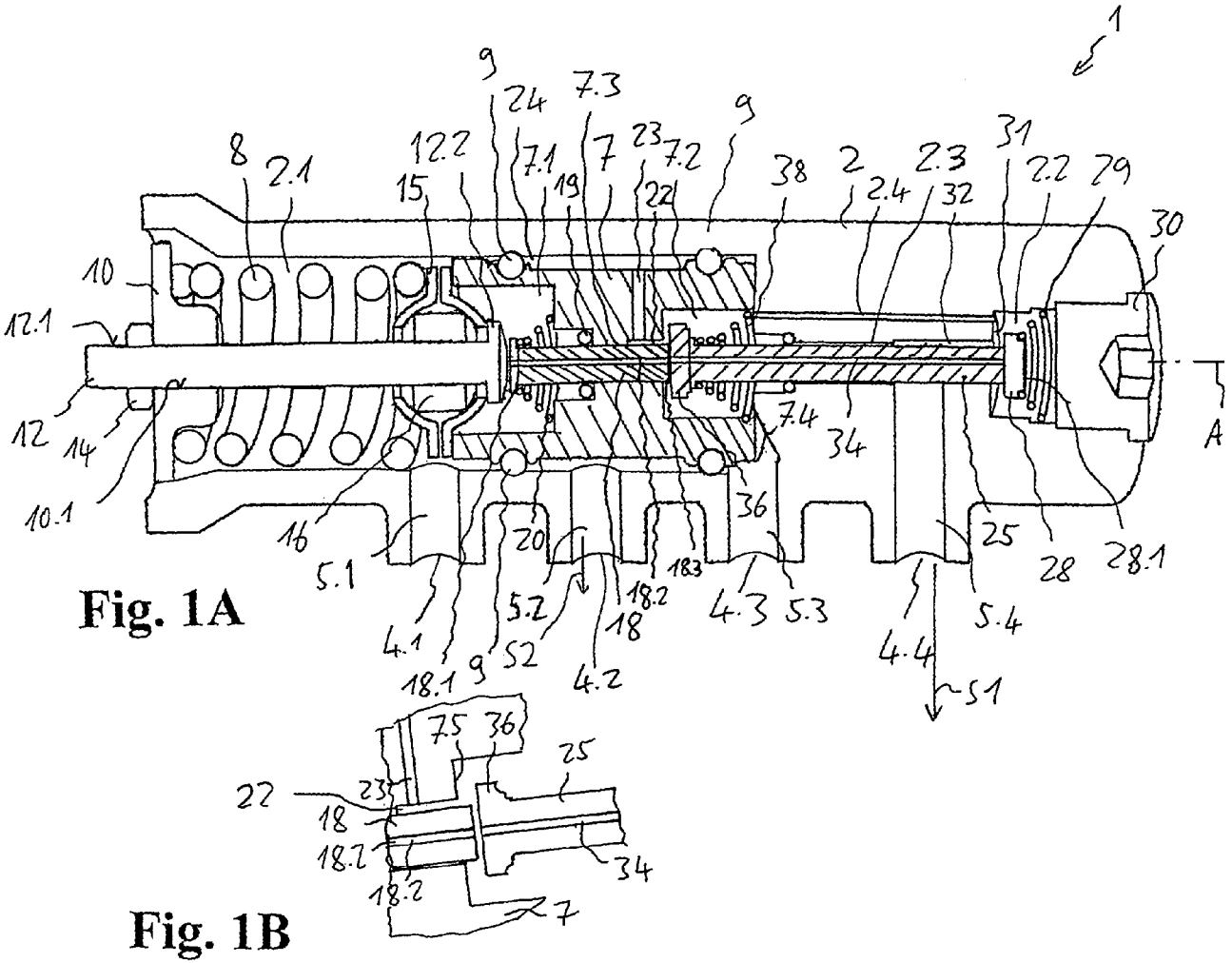
FIG. 1A is a sectional view of a governor according to an embodiment of the present invention.
FIG. 1B is an exploded sectional view of a portion of the governor depicted in FIG. 1A.

Referring to FIG. 1A, a governor 1, which functions as a pressure monitoring device, comprises a governor body 2, which can be made of a solid metal, such as for example aluminum or steel. A first, substantially cylindrical bore 2.1 extends in FIG. 1A from the left end (hereinafter called the rear end) of the governor body 2; a second bore 2.2 extends from the right end (hereinafter called the front end) of the governor body 2. The second bore 2.2 is smaller in its diameter and shorter in its axial length than the first bore 2.1. The governor body 2 further comprises four air connectors 4.1, 4.2, 4.3 and 4.4. Air connector 4.3 is an input air connector that can be connected to a tank, which serves as an air reservoir. Air connector 4.1 is an exhaust air connector for delivering air to an exhaust. Air connector 4.4 is a first signal air connector for outputting an ON-load signal S1 as a pneumatic signal; and air connector 4.2 is a second signal air connector for outputting an OFF-load signal S2 as a pneumatic signal. The air connectors 4.1, 4.2, 4.3, 4.4 comprise air conduit bores 5.1, 5.2, 5.3, 5.4, respectively, which are hereinafter referred to as first, second, third and fourth air conduit bores 5.1, 5.2, 5.3, 5.4.

The first bore 2.1 and the second bore 2.2 extend along an axis of symmetry A of the governor body 2; a smaller, third bore 2.3 connects the bores 2.1 and 2.2. Further, a fourth bore 2.4 extending substantially parallel to and spaced apart from the third bore 2.3 connects the first bore 2.1 and the second bore 2.2, serving as a vent bore. A piston 7 is sealingly slidable in the first bore 2.1; it is preloaded (biased) by a main coil spring 8, which is supported by a rear coil bearing 10 positioned at the outer end of the first bore 2.1. The rear coil bearing 10 is fixed in the governor body 2. An adjustment screw 12 with an outer thread 12.1 can be inserted into an inner thread 10.1 of the rear coil bearing 10 and secured by a nut 14. The adjustment screw 12 extends through the main coil spring 8 and engages with its enlarged front end (right end) 12.2 behind a slidable front coil bearing 15. Therefore, the main coil spring 8 is positioned between the rear coil bearing 10 fixed in the governor body 2 and the slidable front coil bearing 15. The bias or preload of the main coil spring 8 can thus be adjusted via the adjustment screw 12. Furthermore, the position of the slidable front coil bearing 15 with respect to the front end 12.2 of the adjustment screw 12 can be adjusted by a front nut 16 being part of the slidable coil bearing 15. Therefore, the preload of the main coil spring 8 as well as the position of the front end 12.2 can be precisely adjusted.

The main coil spring 8 pushes the piston 7 via the slidable front coil bearing 15 in the front direction against the governor body 2.

The piston 7 comprises a rear chamber 7.1 extending from the rear end of the piston 7 and a front chamber 7.2. The front end 12.2 of the adjustment screw 12 is positioned in the rear chamber 7.1. Both chambers 7.1 and 7.2 extend along the axis of symmetry A of the piston 7; they are connected via a middle piston bore 7.3 extending along axis A. The front chamber 7.2 is connected with the third air conduit bore 5.3 of the input air connector 4.3. A piston plunger 18 can be inserted into the middle piston bore 7.3 of the piston 7 and sealed by an O-ring 19. The rear end of the piston plunger 18 is formed as an enlarged plunger end 18.1; the piston plunger 18 is slidable within the middle piston bore 7.3, and the enlarged rear plunger end 18.1 abuts against the enlarged front end 12.2 of the adjustment screw 12. The piston plunger 18 comprises a central vent bore 18.2 extending through the piston plunger 18 from its enlarged rear end 18.1 to its front end 18.3. A first piston coil spring 20 is supported in the rear chamber 7.1 of the piston 7 and preloads the piston plunger 18 in the rear direction, i.e., against the front end 12.2 of the adjustment screw 12. A conduit space 22 surrounds the front end 18.3 of the piston plunger 18 and is connected via a radial bore 23 with an outer piston space 24 surrounding the piston 7 between its O-rings 9; the outer piston space 24 is connected to the second air conduit bore 5.2 for outputting the OFF-load signal S2.

A pressure plunger 25 is slidably disposed within the third bore 2.3. At the front end (right end) of the pressure plunger 25, a front valve (ON-load valve) 28 is formed, which is biased (preloaded) by a coil spring 29, which is supported by a plug 30 inserted into the second bore 2.2 and thereby fixed in the governor body 2. The fourth conduit bore 5.4 of the first signal air connector 4.4 is connected to an outer plunger space 32 surrounding the pressure plunger 25. The coil spring 29 preloads the ON-load valve 28; if the ON-load valve 28 abuts a valve seat face 31 of the governor body 2, the second bore 2.2 surrounding the ON-load valve 28 is separated or sealed from the conduit bore 5.4 of the first signal air connector 4.4.

Furthermore, a vent bore 34 extends through the pressure plunger 25. The ON-load valve 28 can be pressed against the front end of the vent bore 34 to seal it.

At its rear end, the pressure plunger 25 is equipped with a rear valve 36; the vent bore 34 extends through the rear valve 36. If the rear valve 36 is pressed against the piston plunger 18, the vent bore 34 fits with the vent bore 18.2 extending through the piston plunger 18. The vent bores 34 and 18.2 therefore serve to vent or deliver pressurized air from the second bore 2.2 to the rear chamber 7.1 of the piston 7. The rear chamber 7.1 is connected to the first air conduit bore 5.1 of the exhaust connector 4.1. A coil spring 38 presses the pressure plunger in rearward direction, together with the coil spring 29.

In the ON-load state (operation mode), a first pressure P1 of; for example, 7.5 bar (minimum operation pressure) is stored in the tank connected to the third air connector 4.3. Thus, the first pressure P1 acts on the front surface (right surface) 7.4 of the piston 7 and is connected to the front chamber 7.2 of the piston 7, which front chamber is connected to the third air conduit bore 5.3 of the input air connector 4.3. The front chamber 7.2 is connected with the second bore 2.2 via the vent bore 2.4. Further, the second bore 2.2 is connected with the outer plunger space 32. The first pressure P1 acts onto the front face 28.1 of the ON-load valve 28, together with the coil springs 29 and 38. However, the sum of this pressure force of P1 and the spring forces is not high enough to push the pressure plunger 25 and the piston 7 against the force of the main coil spring 8 in the rearward direction. Thus, the ON-load valve 28 is not pressed against its valve seat face 31 of the governor body 2. And, the operation pressure P1 is supplied to the fourth air conduit bore 5.4 of the first signal air connector 4.4 outputting the ON-load signal S1 as a pressure signal (pneumatic signal).

The valve 36 is pressed against its valve seat 7.5, which is a face area of the piston 7, and therefore the first pressure P1 in the front chamber 7.2 and the vent bore 34 is not delivered to the outer conduit space 22. The second air connector 4.2 and its second air conduit bore 5.2 are connected with the outer piston space 24 surrounding the piston 7 between the two O-rings 9. This outer piston space 24 is connected to the outer conduit space 22 surrounding the front face 18.3 of the piston plunger 18 via the radial bore 23. In this basic state, the plunger 18 does not contact the rear valve 36 and therefore the outer conduit space 22 is connected with the front face 18.3 of the piston plunger 18 and its central vent bore 18.2 extending completely through the piston plunger 18 to its rear face, which is out of contact with the adjustment screw 12. Thus, the rear chamber 7.1 being connected to the first air conduit bore 5.1 of the exhaust connector 4.1 is, in this state, further connected to the second air conduit bore 5.2 of the exhaust connector 4.2; therefore no OFF-load pressure signal S2 is output.

If the pressure in the tank is enhanced to a high second pressure P2 of about 8.5 bar, then this second pressure P2 acts via the front chamber 7.2, the vent bore 2.4 and the second bore 2.2 onto the front face 28.1 of the ON-load valve 28, together with the spring force of the coil springs 29 and 38. The sum of the spring forces of coil springs 29 and 38 and the pressure force of P2 is sufficient to shift the pressure plunger 25 and the piston 7 against the main coil spring 8. Thus, the ON-load valve 28 is pressed onto its valve seat 31, thereby separating the second bore 2.2 from the fourth air conduit bore 5.4. And, the delivery of the ON-load signal S1 is stopped.

Further, the pressure plunger 25 is shifted in FIG. 1A to the left, i.e., in its rearward direction in the third bore 2.3. Furthermore, the piston 7 is shifted to the left, i.e., in rearward direction against the action of the main coil spring 8. By the movement of the piston 7, its front face 7.4 disengages the governor body 2 and therefore its front face is completely charged with the high second pressure P2 pushing it further in the rearward direction.

If the pressure plunger 25 is stopped in its rearward direction, the piston 7 is further pushed in the rearward direction by the action of the pressure P2 acting on its front face 7.4. As a result, the valve 36 disengages its valve seat 7.5 on the piston 7 in the front chamber 7.2 (see FIG. 1B), and the coil spring 20 placed between the piston 7 and the rear end 18.1 together with the pressure P2 acting on the front face of the piston plunger 18 pushes the piston plunger 18 further in the rearward direction. Thus, the plunger 18 disengages the rear valve 36 of the pressure plunger 25.

In this high pressure state of the tank, the front chamber 7.2 is connected with the outer conduit space 22 around the front end 18.3 of the piston plunger 18 and via the radial bore 23 with the outer piston space 24 being connected to the second air conduit bore 5.2 of the second signal air connector 4.2. Thus, an OFF-load signal S2 is output as a pneumatic signal or pressure-on signal from the second signal air connector 4.2. In this high pressure state of the tank, the piston plunger 18 engages the front end 12.2 of the adjustment screw 12 and therefore the central bore 18.2 of the piston plunger 18 is no longer connected to the rear chamber 7.1 of the piston 7, which is connected to the first air conduit bore 5.1 of the exhaust connector 4.1. Thus, the pressure is not delivered to the exhaust.

If the pressure in the tank is afterwards decreased to the first pressure P1, i.e., a normal operation pressure, the above described state of FIG. 1A is again obtained.

Figure 2:
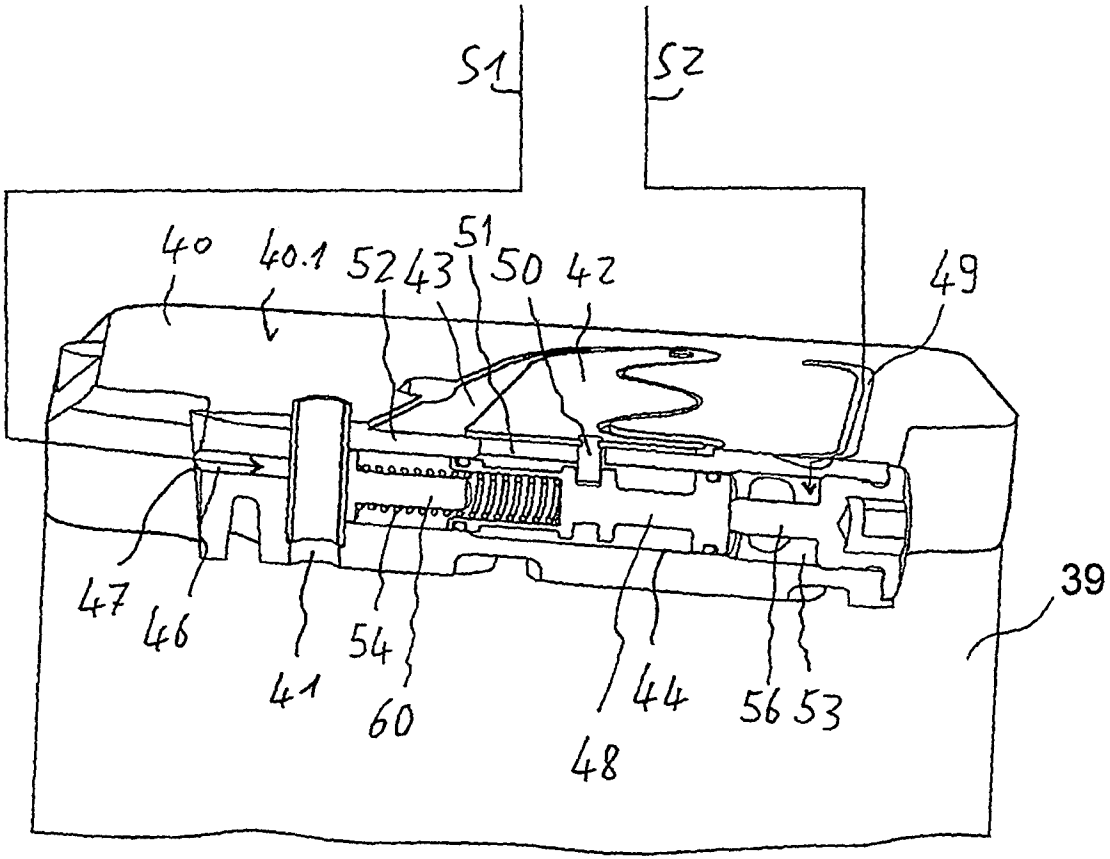
FIG. 2 is a sectional view of an unloader head that can receive pneumatic signals from the governor depicted in FIG. 1A.

According to FIG. 2, the ON-load signal S1 as well as the OFF-load signal S2 are used as pneumatic input signals for controlling the state of a compressor 39. FIG. 2 discloses one embodiment of a head unloader 40, i.e., a cylinder head of the compressor 39, comprising a pneumatic system for using the two pneumatic signals as control inputs.

FIG. 2 shows the action of the pressure signals S1 (ON-load signal) and S2 (OFF-load signal). The head unloader 40 is part of the compressor 39, which is only roughly outlined; the head unloader 40 is used as a cylinder head for closing cylinder bores in the cylinder body of the compressor 39, which cylinder body is mounted on the bottom face of the head unloader. Cylinder head bolts can be placed into cylinder head bolt bores 41 and screwed into threads (inner threads) of the cylinder body of the compressor 39. On the front face 40.1 of the head unloader 40, a groove 43 is formed in which a pivotably hinged sliding reed 42 can be pivoted in a specific angle area. FIG. 2 depicts the ON-position of the head unloader 40, wherein the sliding reed 42 is in its right position in the groove 43, thereby separating two cylinder bores of the compressor from each other. In its actuated position, i.e., the left position in the groove 43, the two chambers of the compressor 39 are connected with each other, thereby forming a bypass between these two chambers; the compressor 39 is in its idle state or OFF-load state with a lower energy consumption and without compressing air.

In the head unloader 40, a cylinder bore 44 extends from the right side in FIG. 2 with step-wise varying diameter. It is connected to an ON-load signal port 46, which leads to a first signal port 47 to which the second air conduit 4.1 of the governor 1 is connected. Thus, the ON-load signal S1 is input into the ON-load signal port 46 (which is not blocked by the sleeve mounted in the cylinder head bolt bore 41).

A control piston 48 is sealingly slidable in the cylinder bore 44. The sliding reed 42 is connected with the control piston 48 via an actuating pin 50 extending through a slot 51 formed in the upper wall 52 surrounding the cylinder bore 44. The actuating pin 50 can be fixed either in the sliding reed 42 or in the control piston 48; both embodiments are possible. Further, other connection means between the sliding reed and the control piston 48 can be employed.

The OFF-load signal S2 is input into a second signal port 49 and further led to a chamber 53 in the cylinder bore 44, which chamber 53 is formed on the right (rear) side of the control piston 48. A coil spring 54 preloads the control piston 48 to the rear side (to the right in FIG. 2) against a stop 56, which is formed in this embodiment by a plug screwed into the cylinder bore 44, thereby defining the unload-position of FIG. 2. The coil spring 54 is supported on a reference piston 60, which is slidable inside the cylinder bore 44. In the ON-load-position of FIG. 2, the reference piston 60 is in its left-most position, which can be defined by the body of the head unloader 40 or the sleeve in the cylinder head bolt bore 41. The ON-load signal S1 presses from the left side (front side) against the front face of the reference piston 60, thereby preloading the coil spring 54 in order to shift the actuating pin 50 into its most right position. If no signal S1 or S2 is present, this state will be achieved as well, since the preload of the coil spring 54 is sufficient to shift the control piston 58 in a defined way to its right-most (rearward) position.

In case the ON-signal S1 is absent, i.e., no pressure against the front face of the reference piston 54, and the OFF-signal S2 is present, then pressurized air is led to the chamber 53 and the rear face of the control piston 48, and the actuating pin 50 is shifted to its left position, thereby adjusting the idle state (OFF-load mode) of the compressor 39.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A pressure monitoring device for controlling a compressor having a first signal port and a second signal port, the device comprising:

an input air connector connectable to an air reservoir and configured to receive an input pressure from the air reservoir;

a first signal air connector configured to output a pneumatic ON-load signal to the first signal port of the compressor to adjust the compressor to an operation mode;

a second signal air connector configured to output a pneumatic OFF-load signal to the second signal port of the compressor for adjusting the compressor to a non-operation mode;

a governor body;

a slidable piston disposed in the governor body, the piston being preloadable in a first direction by a spring, the piston being connectable to the input air connector, the piston being chargeable by the input pressure supplied to the input air connector to exert a pressure force onto the piston in a second direction opposite to the first direction;

a pressure plunger chargeable by the input pressure for movement in the second direction;

a first connection between the input air connector and the first signal air connector, the first connection being separable; and a second connection between the input air connector and the second signal air connector, the second connection being separable;

wherein, when the input pressure exceeds a predefined pressure limit, the pressure plunger is pushed by the input pressure in the second direction to separate the first connection and further open the second connection for outputting the input pressure as the pneumatic OFF-load signal out of the second signal air connector; and wherein, when the input pressure does not exceed the predefined pressure limit, the pressure plunger is not pushed in the second direction, the first connection is not separated, and the input pressure is outputted as the pneumatic ON-load signal out of the first signal air connector.

2. The pressure monitoring device of claim 1, wherein the piston is slidably positioned in a first bore defined in the governor body, the first bore extending to a first side of the governor body.

3. The pressure monitoring device of claim 1, wherein the pressure plunger includes a valve configured to engage a valve seat of the piston to cause the second connection to open when the input pressure exceeds the predefined pressure limit.

4. The pressure monitoring device of claim 1, wherein the pressure plunger includes a valve engageable with a valve seat of the piston, the pressure plunger being configured to push the piston under force of the input pressure when the input pressure exceeds the predefined pressure limit to cause (i) the valve to be engaged with the valve seat, (ii) an effective pressure face being charged by the input pressure to become enlarged, and (iii) the second connection to open.

5. The pressure monitoring device of claim 3, further comprising a piston plunger in a piston bore extending through the piston, the piston plunger including a vent bore to relieve pressurized air via an exhaust connector.

6. The pressure monitoring device of claim 5, wherein the pressure plunger includes a vent bore connectable with the vent bore of the piston plunger to relieve air via the exhaust connector.

7. The pressure monitoring device of claim 5, wherein the second connection includes an outer piston space surrounding the piston and connected with the second signal air connector, an outer conduit space surrounding a front end of the piston plunger, and a bore defined in the piston connecting the outer piston space and the outer conduit space.

8. The pressure monitoring device of claim 5, further comprising an on-load valve chargeable by a further spring and by the input pressure acting in the second direction, wherein when the input pressure does not exceed the predefined pressure limit the input pressure is not sufficient to close the on-load valve and wherein when the input pressure exceeds the predefined pressure limit the input pressure is sufficient to close the on-load valve, push the pressure plunger together with the piston, and initiate disengagement of the piston from the piston plunger.

9. The pressure monitoring device of claim 8, wherein when the input pressure does not exceed the predefined pressure limit a total force acting on the on-load valve and the pressure plunger in the second direction is lower than a total force acting in the first direction.

10. The pressure monitoring device of claim 8, further comprising a bore for receiving the on-load valve, and a further bore connecting the input air connector with the bore for receiving the on-load valve.

* * * * *